US006562423B2

(12) United States Patent
Rubin

(10) Patent No.: US 6,562,423 B2
(45) Date of Patent: May 13, 2003

(54) SPORTS MEMORABILIA ARTICLE AND DISPLAY METHOD

(76) Inventor: Matvey Rubin, 74-12 35th Ave., Jackson Heights, NY (US) 11372

( * ) Notice: Subject to any disclaimer, the term of this patent is extended or adjusted under 35 U.S.C. 154(b) by 0 days.

(21) Appl. No.: 09/827,645

(22) Filed: Apr. 5, 2001

(65) Prior Publication Data

US 2002/0146537 A1 Oct. 10, 2002

(51) Int. Cl.[7] ..... A47G 1/12

(52) U.S. Cl. ..... 428/13; 428/14; 428/542.2; 428/542.4; 40/661; D11/131

(58) Field of Search ..... 428/13, 14, 542.2, 428/542.4; 40/427, 661; D11/131; 206/315.9, 457

(56) References Cited

U.S. PATENT DOCUMENTS

| | | | | |
|---|---|---|---|---|
| D39,904 | S | 4/1909 | Schwarz et al. | |
| 2,454,095 | A | 11/1948 | Sandlovich | |
| D171,933 | S | 4/1954 | Del Mas | |
| D185,908 | S | 8/1959 | Kramer | |
| 3,945,640 | A | 3/1976 | Denmark | 273/85 R |
| D258,125 | S | 2/1981 | Bailey | D11/157 |
| D260,864 | S | 9/1981 | Perry | D11/157 |
| 5,082,110 | A | 1/1992 | Hager | 206/232 |
| 5,165,538 | A * | 11/1992 | Peters | 206/315.9 |
| D351,814 | S | 10/1994 | Young, Sr. et al. | D11/160 |
| D371,225 | S | 6/1996 | Ross | D30/102 |
| D386,117 | S | 11/1997 | Weisenfeld | D11/157 |
| D386,118 | S | 11/1997 | Weisenfeld | D11/157 |
| D393,016 | S | 3/1998 | Young | D21/59 |
| D405,721 | S | 2/1999 | Dennis | D11/117 |
| 6,016,910 | A * | 1/2000 | Rodearmel | 206/315.9 |

FOREIGN PATENT DOCUMENTS

| | | |
|---|---|---|
| FR | 1191427 | * 10/1959 |

* cited by examiner

*Primary Examiner*—Deborah Jones
*Assistant Examiner*—Abraham Bahta
(74) *Attorney, Agent, or Firm*—Wechsler & Wechsler, P.C.; Lawrence I. Wechsler

(57) ABSTRACT

A sports memorabilia article includes a casing at least partially enclosing a sports-related subject to be displayed. The casing is transparent at least over a sufficiently large area portion to permit external viewing of the subject held therewithin. The casing is given the appearance of a particular type of ball suited to use in playing the sport to which the subject displayed within the casing is directed. To achieve such appearance, the ball is either texturized in a manner giving the desired visual impression, silkscreened or otherwise painted either on an exterior surface of the casing or an interior of the transparent portions thereof, or embossed in a pattern resembling seams and other distinguishing surface details characteristic of such ball structure. The combination of subject and surrounding case provides a multilayer visual effect which amplifies the effectiveness of the display, and elicits greater interest and viewing entertainment on the part of the observer. A further embodiment permits user access to an interior of a casing described above to allow user selection of a particular item to be displayed.

20 Claims, 4 Drawing Sheets

SPORTS MEMORABILIA ARTICLE AND DISPLAY METHOD

BACKGROUND OF THE INVENTION

The present invention relates to a sports memorabilia article, and more particularly to a sports memorabilia article and display presenting a multilayer, three-dimensional form. The invention further relates to a method of displaying sports-related memorabilia.

Collecting and displaying sports-related memorabilia has long been a popular diversion, and demand for such articles presently remains extremely high. Heretofore, such articles have generally included cards and other like items of flattened shape having images printed, engraved, embossed or stamped thereon. Additionally, other items intended for display include baseballs, bats, or other items associated with a sport of interest. The aforementioned items have been traditionally displayed in plastic cases permitting external viewing while concomitantly protecting the displayed contents. These display containers, however, generally add nothing to the appeal of the items contained therein, and do not accentuate the nature of the sport to which they are directed.

Accordingly, it is an object of the invention to provide a collectible article for display, investment or trade which overcomes the drawbacks of the prior art.

It is a further object of the invention to provide the collectible article in a form which creates a multilayer visual effect for the viewer such that interest in the article is maintained even after repeated viewings.

It is yet a further object of the invention to provide a method of displaying a sports-related article in a manner which enhances the desirability of the article when so displayed.

SUMMARY OF THE INVENTION

In accordance with these and other objects of the invention there is provided a sports memorabilia article which includes a casing at least partially enclosing a sports-related subject to be displayed. The casing is transparent at least over a sufficiently large area portion to permit external viewing of the subject held therewithin. The casing is given the appearance of a particular type of ball suited to use in playing the sport to which the subject displayed within the casing is directed. To achieve such appearance, the ball is either texturized in a manner giving the desired visual impression, silkscreened or otherwise painted either on an exterior surface of the casing or an interior of the transparent portions thereof, or embossed in a pattern resembling seams and other distinguishing surface details characteristic of such ball structure. The combination of subject and surrounding casing provides a multilayer visual effect which amplifies the effectiveness of the display, and elicits greater interest and viewing entertainment on the part of the observer. The casing which comprises the sport memorabilia article and which resembles a ball used in sports play can be life sized, such as, for example, a baseball, or can be scaled larger or smaller depending on the particular ball represented. For example, when the article takes the form of a golf ball, the dimensions can be increased, and when, for example, a basketball, can correspondingly be reduced for achieving a desired effect and to fit display parameters.

In accordance with an embodiment of the invention, a sports memorabilia article is constructed according to the general guidelines outlined above. The display subject contained within the casing is a three-dimensional model depicting, for example, one or more sports figures, advantageously arranged as desired for presenting a pleasing, stimulating and informative scene. The scene may be simple, for example, simply a baseball player standing at home plate posed as if swinging at a pitch, or may be more complex, for example, depicting a sports maneuver or key event in a sporting event, such as a famous play in a past Super Bowl involving several players arranged in a pattern on the playing field. As a prearranged scene enclosed in the hollow, preferably air filled, casing, the subject held within the casing of the memorabilia article according to the embodiment need not be accessible by the owner, and the casing is advantageously sealed to prevent accumulation of dust or condensation on an interior thereof and on the subject received therein. The display subject can also be a World Series ticket stub, team ring, team pictures, autographs, special cards, etc. The subject is attached to the casing in a manner preventing detached movement of the subject therewithin. Further, the casing advantageously includes a base portion on which a description directed to the subject and/or statistics relating to the players involved in the depicted scene is provided for external viewing. As such, the base portion, which need not be transparent, concomitantly serves as an area for providing informative data externally viewable when the ball-shaped casing is turned to a position in which an outer surface of the base portion is viewable by the observer, and as a substrate for the subject, such as a playing field, which is externally viewable from above through a transparent region of the casing, particularly when the casing is in a display-oriented, upright position. Further, the base can be weighted such that, when disposed in a bottommost position, the casing tends to right itself in a desired orientation. Such weighting can be achieved by increasing the overall density of the base portion, for example, by embedding heavier material within the formed material, or by increasing the relative size thereof.

In accordance with another embodiment, the casing described above serves as a protective enclosure for receiving and displaying a subject of choice by the user directed to a sport which is related to the type of ball suggested by the particular casing design. In this embodiment, the subject may be, for example, a World Series ticket stub, team ring, team pictures, autographs, special cards, etc. The casing is configured such that an interior space defined by the enclosing walls thereof is accessible by the user. In a structural example implementing such accessibility, the casing advantageously includes a domed transparent upper viewing portion and a base portion which may be mutually brought into interference-fit, snap-fit, threaded or other suitable engagement with one another.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
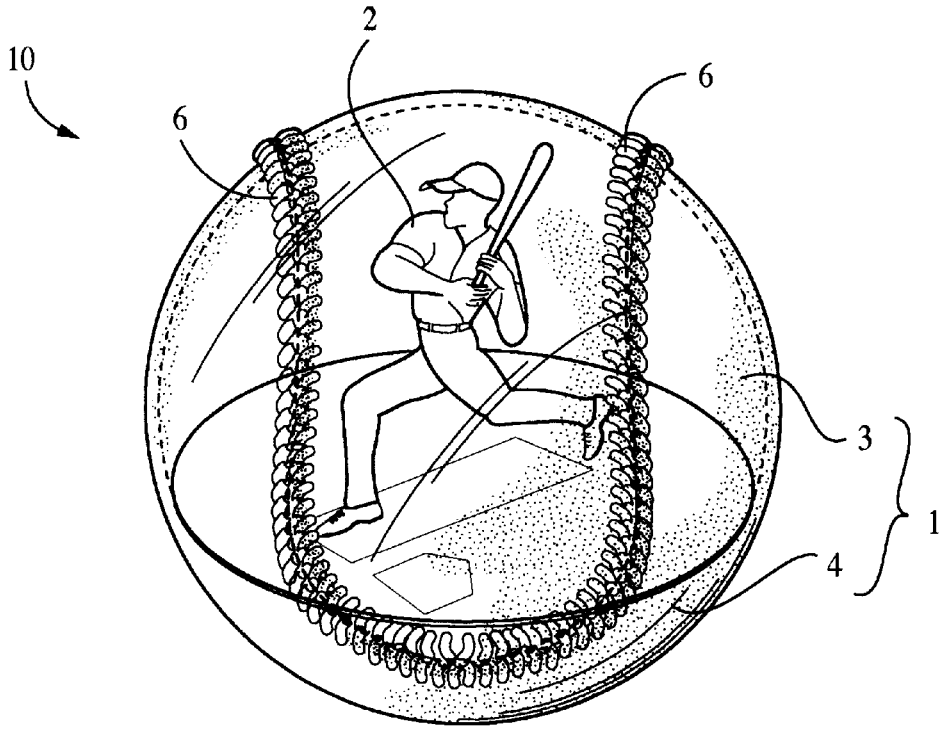
FIG. 1 is a perspective side elevation of an embodiment of a sports memorabilia article in accordance with the invention directed to a baseball related subject.
Figure 2:
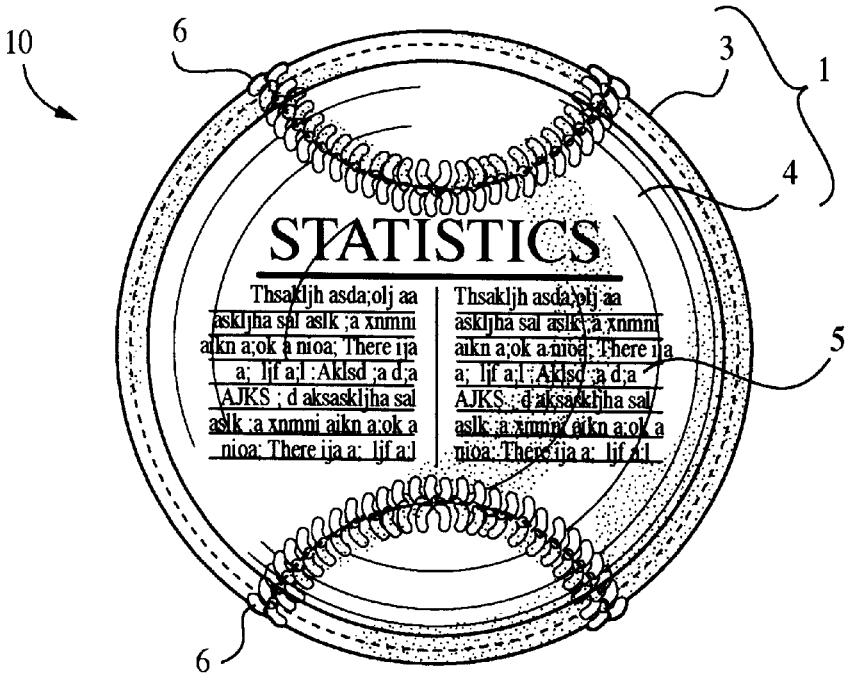
FIG. 2 is a bottom view of the sports memorabilia article of FIG. 1.

Referring now to the figures, and in particular FIGS. 1 and 2, a sports memorabilia article in accordance with an embodiment of the invention is depicted, generally designated 10. The memorabilia article 10 includes a casing 1 configured and disposed to at least partially enclose a sports-related subject 2 to be displayed. The subject 2, may be any item of interest, for example, as illustrated in FIG. 1, a model of baseball player standing in the batter's box holding a bat. In the depicted example, the casing 1 entirely encloses the subject 2, thereby advantageously defining an interior space sealed from the outside, such that accumulation of dust or condensation within the casing 1 is inhibited.

The casing 1 is transparent at least over a sufficiently large area portion to permit external viewing of the subject 2 held therewithin, such region being provided advantageously in the embodiment of FIG. 1 in the form of a transparent domed upper portion 3. The casing 1 further advantageously includes a base portion 4 which is generally oriented in a bottommost position during resting display on a tabletop or the like. A description 5 directed to the subject and/or statistics relating to the subject is advantageously provided within a region defined by the base portion 4 for viewing thereof from an exterior facing surface of the base portion 4. In addition, this region can include an area having a suitable surface configuration for receiving an autograph or other written information added by the user as desired. As such, the base portion 4, which need not be transparent, concomitantly serves as an area for providing informative data or other markings externally viewable when the ball-shaped casing 1 is turned to a position in which an outer surface of the base portion 4 is viewable by the observer, and as a substrate for the subject 2, such as a playing field (for example, permitting depiction of a batter's box and home plate, as shown in FIG. 1), which is externally viewable through the transparent domed upper portion 3 of the casing 1.

In accordance with an embodiment of the invention, the casing 1 is given the appearance of a particular type of ball suited to use in playing the sport to which the subject displayed within the casing is directed. In the depicted example of FIGS. 1 and 2, the ball structure is that of a baseball corresponding to the subject 2. To achieve such appearance, the ball is either texturized in a manner giving the desired visual impression, silkscreened or otherwise painted either on an exterior surface of the casing 1 or an interior of the transparent portion 3 (or portions) thereof, or embossed in a pattern resembling seams 6 and other distinguishing surface details characteristic of such ball structure. The combination of subject 2 and surrounding case 1 provides a multilayer visual effect which amplifies the effectiveness of the display, and elicits greater interest and viewing entertainment on the part of the observer.

Figure 3:
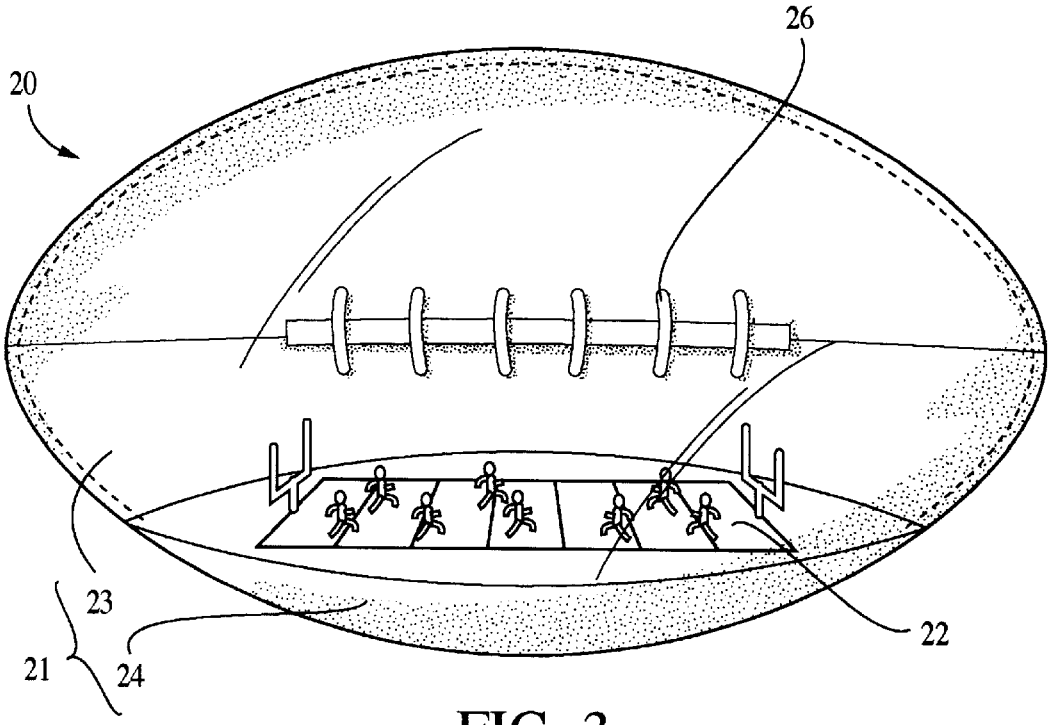
FIG. 3 is a perspective side elevation of another embodiment of a sports memorabilia article in accordance with the invention directed to a football related subject.
Figure 4:
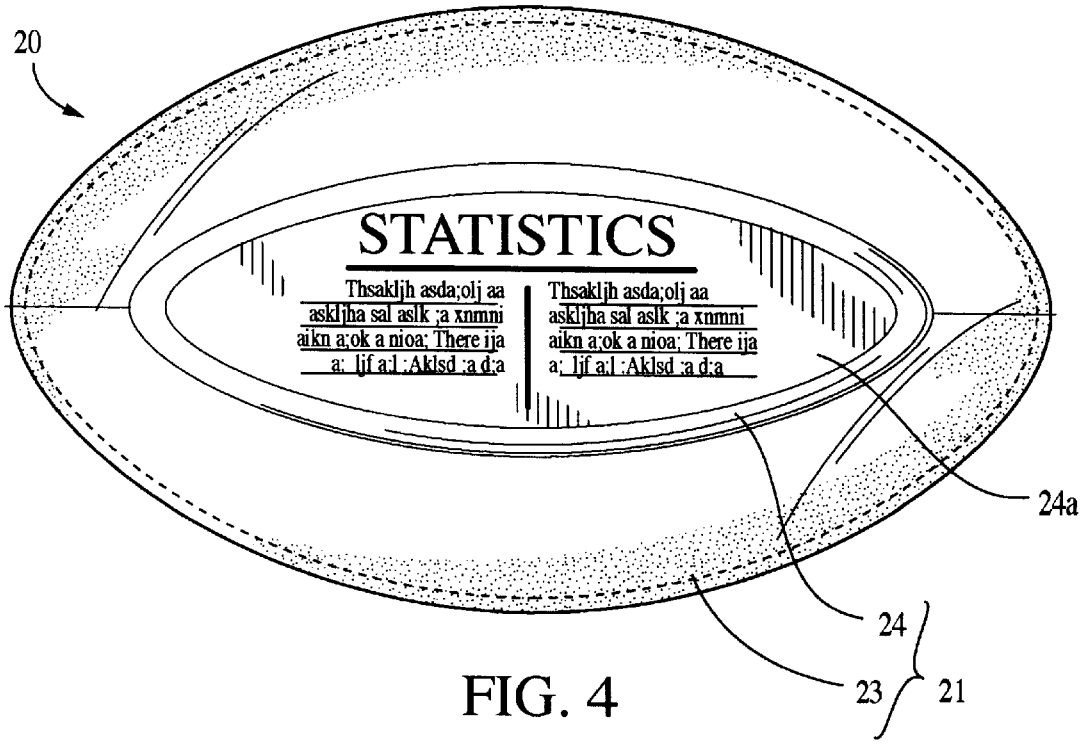
FIG. 4 is a bottom view of the sports memorabilia article of FIG. 3.

Most balls used in sports play are spherical, and the above described embodiment is representative of the general construction of such typical configuration. However, the present invention will also find application relative to other ball configurations having non-spherical dimension. Turning now to FIGS. 3 and 4, an embodiment is depicted in which a sports memorabilia article 20 is fashioned to resemble a football. In the depicted embodiment, the sports memorabilia article 20 includes a casing 21 defined aggregately by a transparent viewing portion 23 and a base portion 24. Base portion 24 is not of circular shape as in the previously described embodiment, but rather, is elongated, and serves, internal of the casing 21, as a substrate for presenting the subject 22, which, in the particular example, is a scene of a football field on which memorable play of a notable football game is recreated in miniature. An exterior of the base portion 24 advantageously contains information pertinent to the play or other statistics of interest. The base portion 24 advantageously contains a flat central region 24*a* which allows the casing 21 to rest securely on a display surface without rolling.

The various components of the memorabilia article 10, 20 according to the aforementioned embodiments, including the casing 1, 21, the base 4, 24 and the subject 2, 22 can be produced in practice using any suitable technique, for example, any number of conventional methods of molding or fabrication. The item is advantageously comprised, at least in part, of a thermoplastic which lends itself to production using injection molding techniques. The memorabilia article 10 of FIGS. 1 and 2 could for example be manufactured by injection molding the base 4 and the subject 2 as a unit, and the transparent portion 3 in bisected form. Any additional surface details desired on the subject 2 or the surface of the base 4 serving as a substrate for the subject 2, such as lines resembling a playing field, would be painted prior to assembly of the various molded parts. The parts are then joined using, for example, sonic welding, or other techniques employed for fixing together previously molded parts. As depicted in the example of FIGS. 1 and 2, the appearance of a baseball is advantageously achieved by disposition of a raised external embossing corresponding to stitched seams 6 of a real baseball, conveniently accomplished during plastic injection molding of the casing 1 by a suitably configured internal mold configuration. Likewise, texturing representative of leather and stitching 26 is accomplished by analogous means in the football embodiment of FIGS. 3 and 4. Light passing through the transparent portion 3, 23 is bent in the region of the embossed seams (stitching) 6, 26 adding to the interesting effect generated by the multilayer arrangement.

Figure 5A:
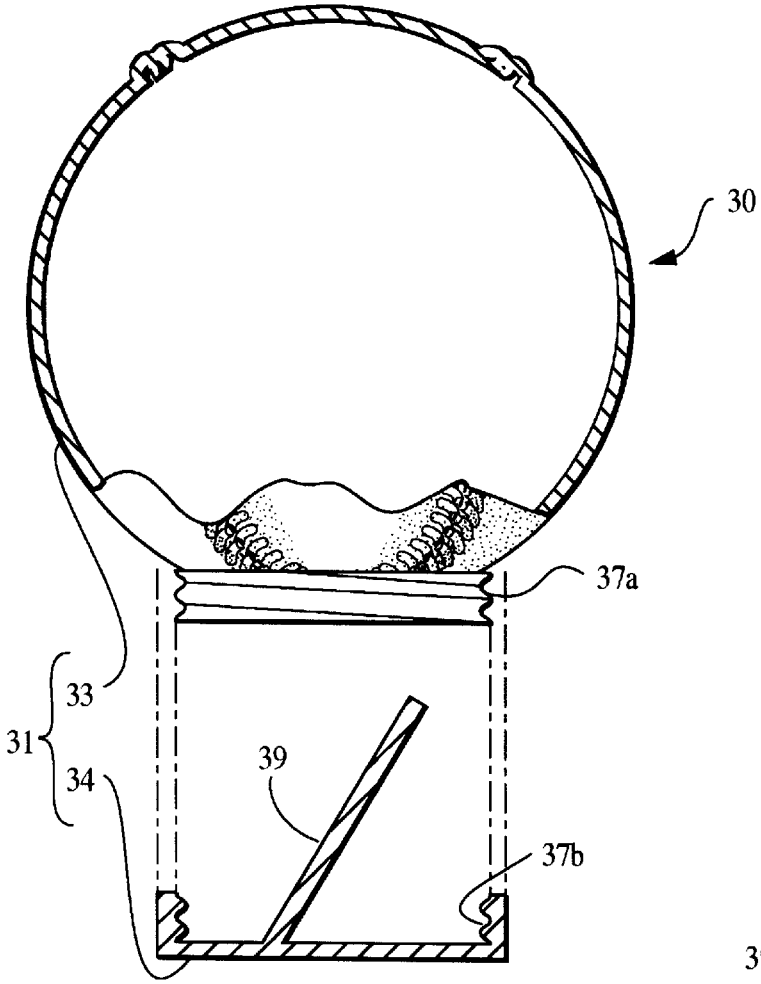
FIG. 5*a* is an exploded side elevation of yet another embodiment of a sports memorabilia article in accordance with the invention shown in partial cross-section and directed to a protective enclosure for receiving and displaying a subject of choice by the user of a baseball related subject.
Figure 6:
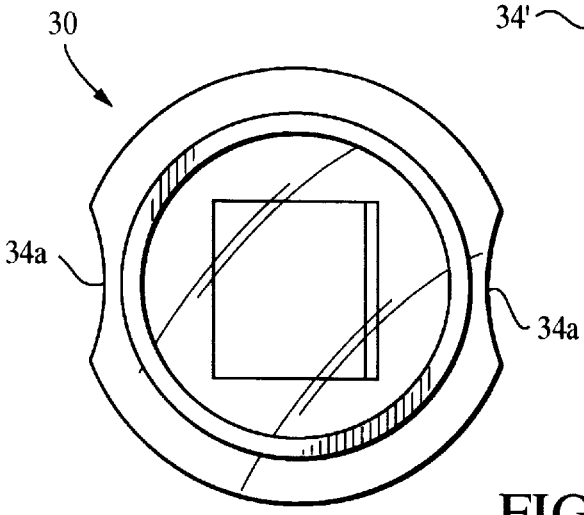
FIG. 6 is a plan view of the sports memorabilia article of FIG. 5*a;*

The above described embodiments are both directed to articles which contain displayed subjects which are not user selected. However, the utility and scope of the invention is intended to extend, as well, to a display in accordance with which a user can determine the nature of the subject enhanced by the casing which serves to enhance the displayed article by providing a multilayer dimension. Referring now to FIGS. 5*a* and 6, an embodiment of such sports memorabilia display kit 30 is depicted, which uses a baseball for purposes of example only. The sports memorabilia display kit 30 is generally configured analogously with the above described embodiments, with the exception that user access to an interior space thereof is provided such that a subject article of choice can be inserted and subsequently displayed. To this end, a casing 31 is comprised of separable parts including a viewing portion 33 and a base portion 34. Mutually cooperative coupling structure is provided to permit separation of the casing 31, shown in the depicted example conveniently in the form of screw threads 37*a* and 37*b* carried on the viewing portion and the base, respectively. The depicted embodiment also includes an optional article support 39 for propping up a card or other displayed item. Also, for purposes of facilitating opening and closing of the casing 31, flats, or as depicted in FIG. 6, scallops 34*a*, are advantageously provided for better grip.

Figure 5B:
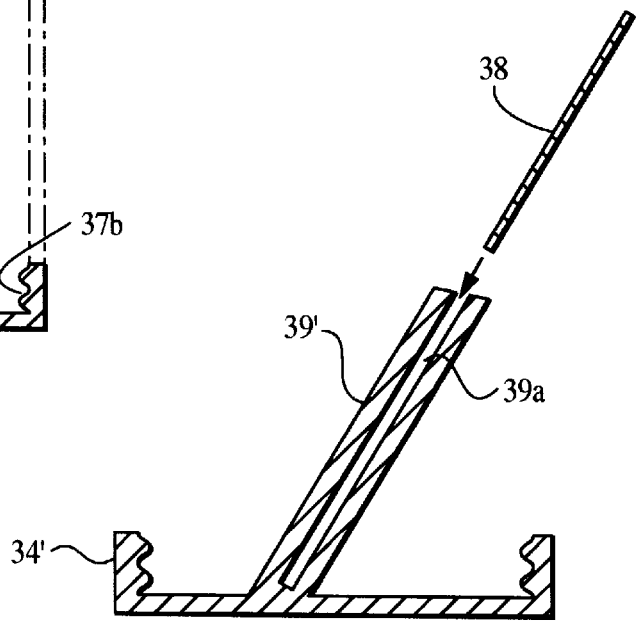
FIG. 5*b* is a cross-sectional view of an alternative embodiment of the base portion of FIG. 5*a*, and which includes an article support adapted for receiving a photograph, ticket stub, or other flat object for protected display.

FIG. 5*b* is directed to a kit embodiment intended for protected display of a photograph, ticket stub, or other article of flattened configuration. The embodiment employs the general design parameters of FIG. 5*a*, with the exception of the design of the base portion 34. In accordance with the embodiment, a differently configured base portion 34' includes a modified article support 39' which includes a reception slot 39*a* formed in a transparent region of the article support 39' permitting slidable reception of a flattened article 38, such as a ticket stub, photograph, autograph, or other similar item.

Figure 7:
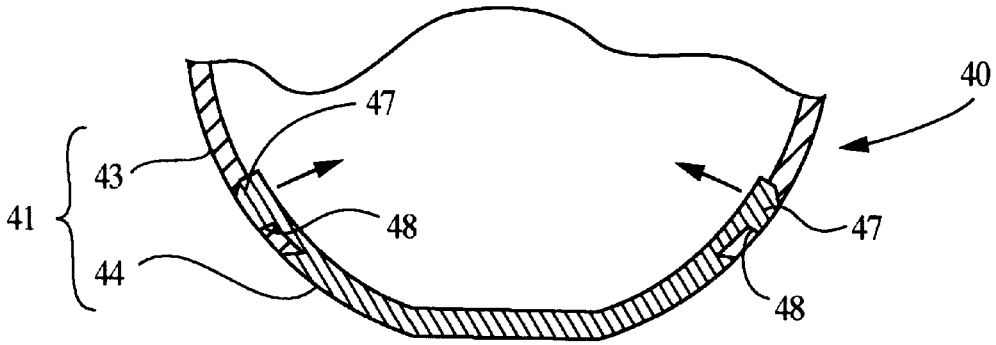
FIG. 7 is a partial cross-sectional view of an alternative embodiment of a kit directed to receiving and displaying a subject of choice by the user.

Although the depicted embodiments of FIGS. 5*a*, 5*b* and 6 employ threaded engagement of the viewing and base portions, it is noted that any other means for providing temporary securement can be alternatively practiced without departure from the invention. Such means may include, for example, interference fit, bayonet mounting, etc. The selection of the particular structure used will be based in part on the particular application. For example, when the embodiment is configured as a football in which the base portion is elongated in shape, using threaded securement would not be the preferred method of attachment, and perhaps interference fit would serve the purpose better. Additionally, the coupling structure can take the form of clips carried on one of the casing parts engageable with slots formed in a remaining one of the parts. Such embodiment is depicted in FIG. 7, generally designated 40, and in which a casing 41 includes a viewing portion 43 and a base portion 44, clips 47 are provided on the base portion, which is made of a resiliently deformable material, and are engageable with slots 48 formed in the viewing portion in an appropriate location. To separate the viewing portion 43 from the base portion 44, the clips 47 are resiliently urged in the direction of the inwardly pointing arrows, thereby releasing their engagement in the slots 48. The clips 47 are then simply snapped back into the slots for reassembly.

Figure 8:
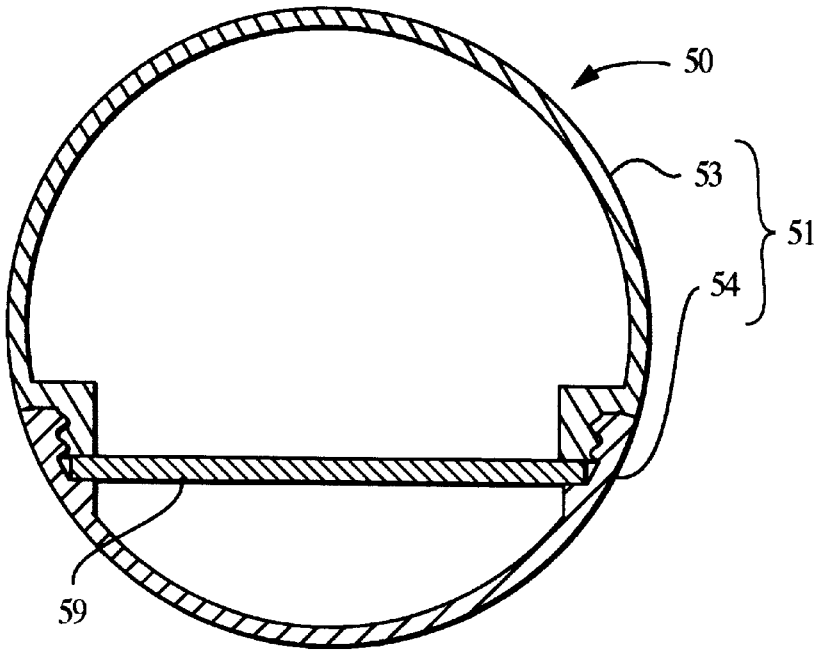
FIG. 8 is a cross-sectional side elevation of yet another embodiment of a sports memorabilia display kit.

Turning now to FIG. 8, another embodiment of a sports memorabilia display kit is depicted, generally designated 50. The sports memorabilia display kit 50 in accordance with the embodiment of FIG. 8 includes a casing 51 comprised of separable parts including a viewing portion 53 and a base portion 54, which are constructed in analogous fashion to the corresponding elements of FIGS. 5*a* and 6. However, in addition to including the viewing portion 53 and the base portion 54, the sports memorabilia display kit 50 further comprises a removable disk 59 which serves as an article support which can advantageously be carried, separate of a remainder of the sports memorabilia display kit 50, to an event, for receiving an autograph of a sports celebrity on a prepared surface thereof, which is suitably textured or coated so as to be adapted to such purpose. Such surface preparation is known in the art, and therefore not described herein in greater detail. Use of the removable disk 59 need not be limited to reception and display of autographs, but can also be used for receiving user applied written, embossed or otherwise visually recorded subject matter on upper and/or lower surfaces thereof for later display, removal thereof from the sports memorabilia display kit 50 facilitating the addition of such visual information. When replaced, the removable disk 59 is secured in convenient fashion, for example, securably held in captive engagement between confronting surfaces of the viewing portion 53 and the base portion 54 when same are brought into mutual secured engagement, as shown.

It is noted that although the examples for purposes of disclosure are directed specifically to the subject of baseball and a football, other subjects of interest may also include basketball, golf, soccer, tennis, volleyball, etc., without departure form the contemplated scope of the invention. Furthermore, although shown as a single domed region, the transparent portion 3 (23, 33, 43 and 53) may alternatively be provided as two or more discontinuous transparent regions separated by opaque or translucent regions and which permit internal viewing from a plurality of angles.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A memorabilia article, comprising:

a subject of interest related to a particular sport; and a casing at least partially enclosing said subject of interest, at least an area portion of said casing being transparent to permit external viewing of the subject of interest held therewithin through said area portion, said casing presenting a discernable appearance of a particular type of actual ball suited for use in playing said sport to which the subject of interest is directed.

2. A memorabilia article according to claim 1, wherein said casing includes:

a base portion; and an upper portion secured to said base, said upper portion including said area portion which is transparent.

3. A memorabilia article according to claim 2, wherein said upper portion is domed and constitutes a majority of a total area of said casing.

4. A memorabilia article according to claim 2, wherein said base portion is externally configured to facilitate stable resting display of said casing on a support surface.

5. A memorabilia article according to claim 2, wherein said base includes externally viewable markings.

6. A memorabilia article according to claim 2, wherein said base is structurally adapted for receiving applied visual data.

7. A memorabilia article according to claim 6, wherein said visual data includes at least one autograph.

8. A memorabilia article according to claim 1, wherein said discernable appearance includes at least one of:

a shape approximating a corresponding shape of the actual ball; and a visually perceptible pattern corresponding to an exterior surface appearance of the actual ball.

9. A memorabilia article according to claim 8, wherein said visually perceptible pattern is achieved by at least one of texturing, silkscreening, surface printing and tinting of selected regions of said casing.

10. A memorabilia article according to claim 8, wherein said visually perceptible pattern is achieved by at least one of texturing, embossing, silkscreening, surface printing and tinting of selected regions of said casing.

11. A memorabilia article according to claim 8, wherein said visually perceptible pattern is achieved by a surface configuration within at least said area portion which is transparent which bends light passing through said casing.

12. A memorabilia article according to claim 1, wherein said subject of interest includes at least one three-dimensional object.

13. A memorabilia article according to claim 1, wherein said subject of interest includes a model of a player of the sport.

14. A memorabilia article according to claim 1, wherein said subject of interest is a depiction of a play in a particular game of the sport.

15. A memorabilia article according to claim 1, wherein said casing is one of a larger, a smaller and a same size as the actual ball.

16. A memorabilia display kit for receivable display of a subject of interest related to a particular sport, comprising:

a casing including a base portion and a viewing portion engageable thereto, at least an area portion of said viewing portion being transparent to permit external viewing of the subject of interest through said area portion when said subject of interest is received in said casing, the casing presenting a discernable appearance of a particular type of actual ball suited for use in playing said sport to which the subject of interest is directed.

17. A memorabilia display kit according to claim 16, wherein said base and said viewing portion include mutually cooperative coupling structure.

18. A memorabilia display kit according to claim 16, further comprising an article support including a reception slot for receivably accommodating said object of interest having a generally flattened configuration.

19. A memorabilia display kit according to claim 16, further comprising a removable member which is held in a secured position between said base and said viewing portion when same are mutually engaged with one another.

20. A method of displaying a subject of interest related to a particular sport, comprising:

configuring a casing to resemble a ball suited for use in playing said sport, at least an area portion of said casing being transparent; and at least partially enclosing the subject of interest within said casing such that said subject of interest can be externally viewed through said area portion of said casing.

* * * * *